US005659292A

United States Patent [19]

Tice

[11] Patent Number: 5,659,292

[45] Date of Patent: Aug. 19, 1997

[54] APPARATUS INCLUDING A FIRE SENSOR AND A NON-FIRE SENSOR

[75] Inventor: Lee D. Tice, Bartlett, Ill.

[73] Assignee: Pittway Corporation, Chicago, Ill.

[21] Appl. No.: 391,208

[22] Filed: Feb. 21, 1995

[51] Int. Cl.[6] ..... G08B 19/00

[52] U.S. Cl. ..... 340/522; 340/506; 340/517; 340/523; 340/825.06; 340/577; 340/286.05; 340/293

[58] Field of Search ..... 340/506, 517, 340/577, 521, 522, 523, 526, 527, 532, 825.06, 825.16, 293, 286.05

[56] References Cited

U.S. PATENT DOCUMENTS

| | | | |
|---|---|---|---|
| 4,536,747 | 8/1985 | Jensen | 340/502 |
| 4,611,197 | 9/1986 | Sansky | 340/522 |
| 4,660,024 | 4/1987 | McMaster | 340/506 |
| 4,725,820 | 2/1988 | Kimura | 340/522 |
| 4,749,985 | 6/1988 | Corsberg | 340/523 |
| 4,831,361 | 5/1989 | Kimura | 340/506 |
| 5,486,811 | 1/1996 | Wehrle et al. | 340/522 |

FOREIGN PATENT DOCUMENTS

| | | |
|---|---|---|
| A-396767 | 11/1990 | European Pat. Off. . |
| A-654770 | 5/1995 | European Pat. Off. . |
| A-418411 | 3/1991 | Germany . |
| A-4127004 | 2/1993 | Germany . |
| 2206433 | 1/1989 | United Kingdom . |

OTHER PUBLICATIONS

Von Dr. Gustav Pfister Mannedorf; Fehlalarme in der Branddetektion: Dank neuer Technologie bald vom Tisch?; Marz 94; pp. 37–42.

Dipl.–Ing. Michael Buschmann; Intelligentes Trio; 14 Oktober 1994; p. 408.

*Primary Examiner*—Brent A. Swarthout
*Assistant Examiner*—Daryl C. Pope
*Attorney, Agent, or Firm*—Dressler, Goldsmith, Milnamow & Katz, Ltd.

[57] ABSTRACT

Outputs from a smoke detector and non-fire sensors such as temperature and humidity can be combined to produce a delay in a signal from the smoke sensor indicative of a potential fire condition. The signals can be combined locally and all of the sensors can be carried in a single housing. Alternately, the sensors can be carried in separate housings and combined at a remote control panel. The value output from the humidity and temperature sensor can be used in determining whether or not to produce a delay. Alternately, the rate of change of either or both parameters can be used to determine whether a delay is necessary.

8 Claims, 3 Drawing Sheets

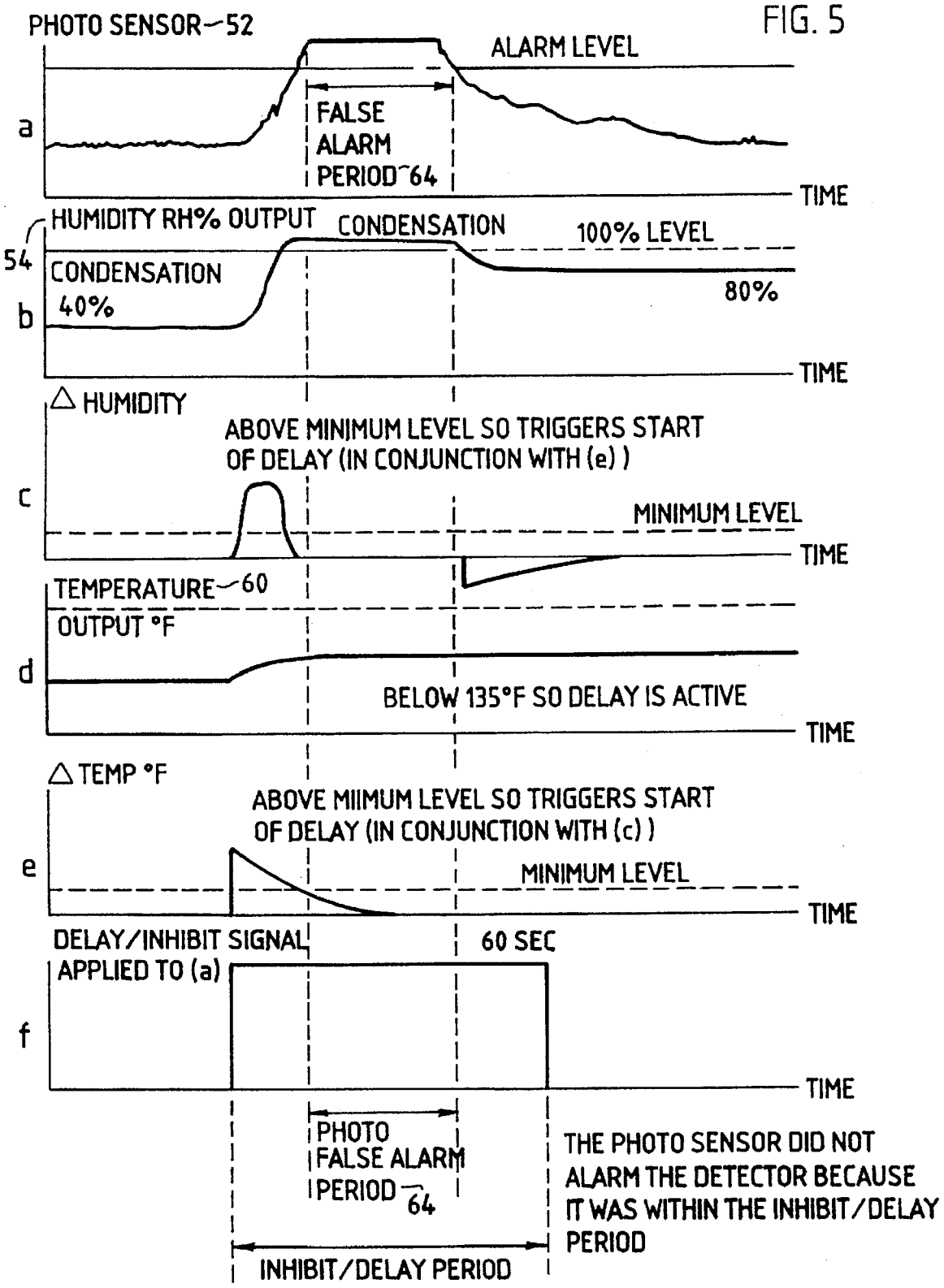
FIG. 5
PHOTO SENSOR—52
ALARM LEVEL
a
FALSE ALARM PERIOD—64
TIME
HUMIDITY RH% OUTPUT
CONDENSATION
100% LEVEL
54
CONDENSATION 40%
80%
b
TIME
△ HUMIDITY
ABOVE MINIMUM LEVEL SO TRIGGERS START OF DELAY (IN CONJUNCTION WITH (e))
c
MINIMUM LEVEL
TIME
TEMPERATURE—60
OUTPUT °F
d
BELOW 135°F SO DELAY IS ACTIVE
TIME
△ TEMP °F
ABOVE MIIMUM LEVEL SO TRIGGERS START OF DELAY (IN CONJUNCTION WITH (c))
e
MINIMUM LEVEL
TIME
DELAY/INHIBIT SIGNAL APPLIED TO (a)
60 SEC
f
TIME
PHOTO FALSE ALARM PERIOD—64
THE PHOTO SENSOR DID NOT ALARM THE DETECTOR BECAUSE IT WAS WITHIN THE INHIBIT/DELAY PERIOD
INHIBIT/DELAY PERIOD

APPARATUS INCLUDING A FIRE SENSOR AND A NON-FIRE SENSOR

FIELD OF THE INVENTION

The invention pertains to ambient condition detection devices. More particularly, the invention pertains to such devices which include additional sensors and circuitry for the purpose of reducing nuisance alarms.

BACKGROUND OF THE INVENTION

Fire detection systems have been recognized as being useful and valuable in commercial buildings in providing an early alarm in the event of a developing fire. From the point of view of responding to a fire condition and potentially evacuating some or all of the associated building, the earliest possible detection of the fire condition is preferred.

Counterbalancing the need for early detection, is a need to minimize or eliminate, if possible, the existence of false or nuisance alarms. Such alarms occur as a result of electrical or other types of environmental noise present in buildings wherein the alarm systems are installed.

Detectors are known which detect not only a potential fire condition, but also detect non-fire environmental conditions. Such known detectors adjust an alarm threshold in response to the presence or the absence of a detected environmental condition.

Environmental conditions of interest include the presence or absence of human beings in the region under surveillance, the condition of machinery in the region under surveillance, along with the time of day. Other conditions of interest include humidity as well as pollution levels in the ambient atmosphere.

Thus, there continues to be a need for multiple sensor detection devices which take into account both ambient conditions such as potential or actual fires along with other environmental conditions. Preferably, such devices could be manufactured at a cost comparable to known devices.

SUMMARY OF THE INVENTION

A multiple sensor detection apparatus includes a first sensor for purposes of detecting the presence of a selected ambient condition such as potential or actual fire condition as well as a second sensor for detecting a different environment condition. An output from the first sensor, indicative of a fire or gas condition, is enabled only in the absence of an output from the second, environmental sensor. An important benefit of minimizing false alarms is achieved thereby.

Representative sensors of the first type include fire, gas, temperature, intrusion sensors or the like. Representative sensors of the second type include humidity, ambient pollution level, time of day, presence or absence of sunlight, or the presence or absence of individuals in the region being monitored.

In one aspect of the invention, the outputs of the two sensors are coupled by circuitry which carries out an "and" function. In this instance, in the presence of a selected environmental condition, any output from the ambient condition sensor indicative of gas, fire, temperature or the like is inhibited at least for a predetermined period of time. In the absence of an output from the environmental sensor, the ambient condition sensor produces an indicium indicative of the sensed gas, temperature or fire condition.

In yet another aspect of the invention, the apparatus can include a control element for the purpose of processing outputs from the two sensors. In yet another aspect of the invention the outputs can be transmitted to and processed at a remote control fire panel. The sensors can be located together in the same housing or spaced apart in different housings.

These and other aspects of the attributes of the present invention will be discussed with reference to the following drawings and accompanying specification.

BRIEF DESCRIPTION OF THE DRAWING

FIG. 5 includes a series of graphs illustrative of various aspects of the present invention.

DETAILED DESCRIPTION OF THE PREFERRED EMBODIMENT

Figure 1:
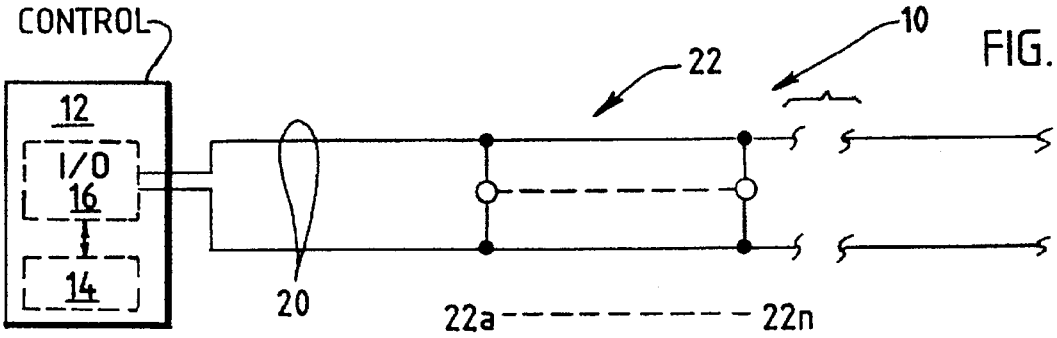
FIG. 1 is an overall block diagram of a system in accordance with the present invention.

While this invention can be embodied in different structures and methods, there are shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 illustrates a surveillance or a monitoring system 10. The system 10 includes a control unit 12 which could be located at a central control office in a building. The control unit 12 includes a control processor 14, which could be implemented as a programmed microprocessor.

The processor 14 is coupled via bidirectional communications links to input/output circuitry 16. The circuitry 16 is in turn coupled to a common bidirectional communications link 20.

A plurality of detector devices 22 is coupled to the link 20 for bidirectional communication with the control element 12.

The members of the plurality 22, detectors 22*a* . . . 22*n*, each include an ambient condition sensor such as a temperature, gas, fire or intrusion sensor as well as a second, different, environmental detection sensor. For example, the environmental detection sensor could separately detect humidity, pollution level, time of day, presence or absence of individuals in the region under surveillance, or presence or absence of daylight.

Figure 2:
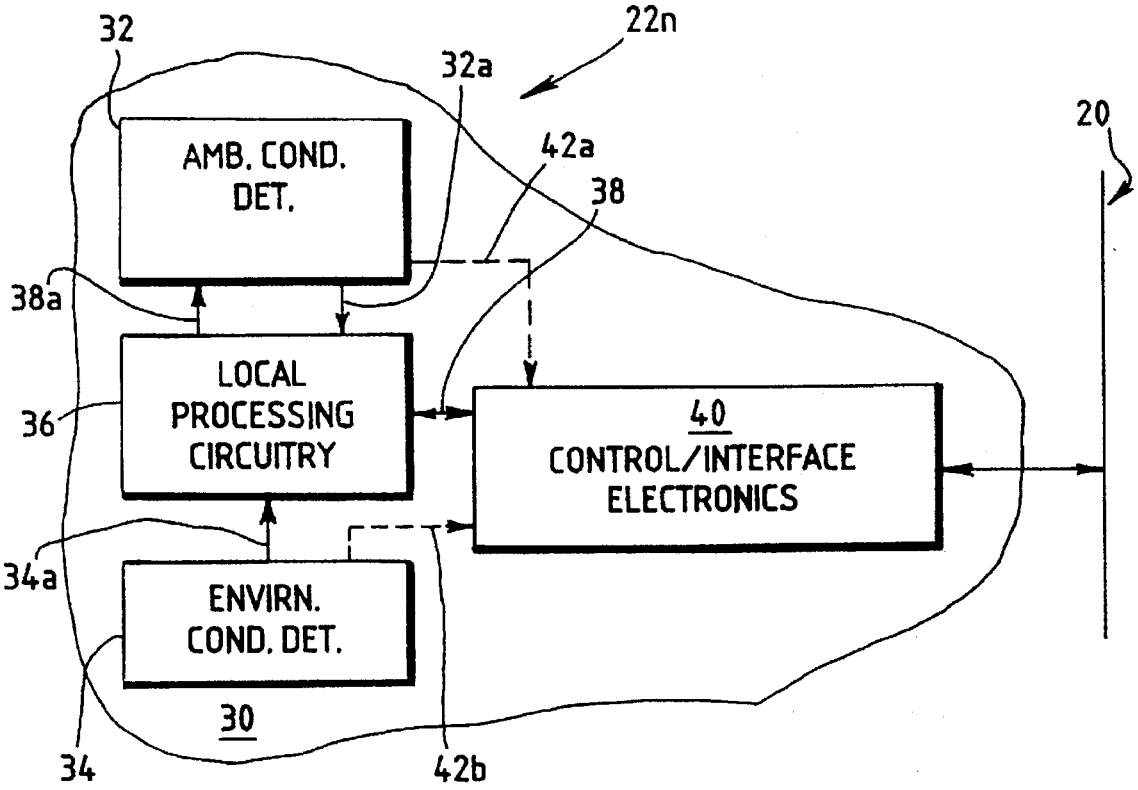
FIG. 2 is a block diagram of a detector in accordance with one aspect of the present invention.

FIG. 2 illustrates a block diagram of one embodiment of an apparatus 22*n* usable with the system 10. The apparatus 22*n* can include a housing, indicated at 30.

The housing 30 carries an ambient condition detector 32. The detector 32 could include a gas concentration detector, a temperature detector, a smoke detector, an intrusion detector or any other type of detector of interest.

The housing 30 also carries an environmental condition detector 34. The detector 34 is different from the detector 32 and is not intended to function similarly as a fire sensor. The detector 34 for example, could be a humidity detector, a pollution level detector, an incident light detector, or the like.

An indicium of the presence of the detected ambient condition, carried on an output line 32*a* from the ambient condition detector, is affected or altered, for example delayed, in response to an output on a line 34*a* of the environmental condition detector. The variation or altering can be accomplished through the use of local processing circuitry 36.

Alternately, the outputs of the two sensors could be transmitted via the link 20 to the control unit 12. The outputs could then be processed at the unit 12. The sensors 32, 34 need not be carried on the same housing.

The circuitry 36, for example, could carry out an "and" function producing an output without delay on a line 38, indicative of the sensed ambient condition, only in the absence of the output on the line 34*a*. Alternately, the processing circuitry 36, via a line 38*a*, could inhibit Operation of the detector 32 for a predetermined period of time in response to the presence of an output 34*a* from the environmental condition detector 34. It will be understood that other variations for altering or delaying an output from the ambient condition detector 34 come within the spirit and scope of the present invention.

In one aspect of the invention, the output on the line 38 is in turn processed by control/interface circuitry 40 which provides a bidirectional link to and from the communication link 20. The electronics 40 could include for example, address detection circuitry as well as command detection and decoding circuitry for the purpose of sending data to the control unit 12 or receiving instructions or data therefrom.

Thus, in accordance with the structure of the apparatus 22*n* of FIG. 2, the control/interface circuitry 40 transmits an indicium, carried on the line 38, which is indicative of the presence of the selected ambient condition as sensed in detector 32 and the absence of the selected environmental condition as sensed in the detector 34.

Alternately, outputs from the ambient condition detector 32 and the environmental condition detector 34, as illustrated in phantom in FIG. 2, could be coupled directly to the control/interface electronics 40 via lines 42*a* and 42*b*. In this instance, the indicia received from the ambient condition detector 32, and the environmental condition detector 34 can be transmitted via the communication link 20 to the control element 12 and processed therein by the processing element 14.

Processing can take the form of suppressing the output from the ambient condition detector 32 for the duration of the presence of the output from the environmental condition detector 34. Alternate forms of processing such as having delays in responding to the ambient detector that are determined by the level of the environmental condition detector 34 are also possible without departing from the spirit and scope of the present invention. It is also possible to use multiple ambient and/or multiple environmental condition sensors/detectors in determining the delay time. In addition, rates of changes of the environmental sensor(s) may be used to determine the delay time.

Figure 3:
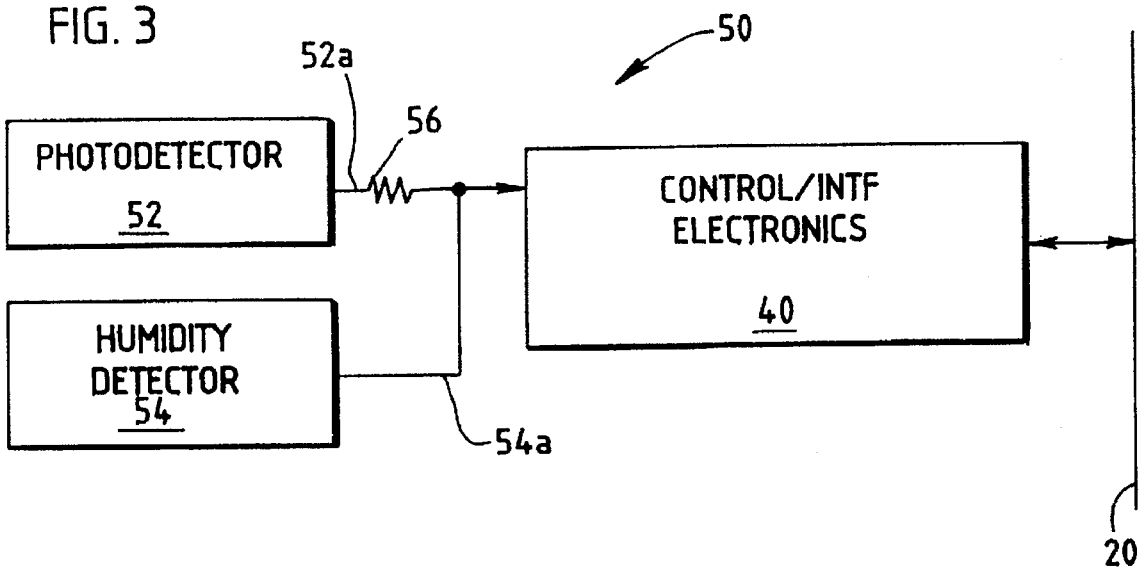
FIG. 3 is a block diagram of an alternate form of a detector.

FIG. 3 illustrates a particular form of the apparatus 22*n*. The apparatus 50 of FIG. 3 includes a photoelectric smoke detector 52 of a conventional type. Such units usually include a housing which carries a radiant energy source, such as a laser or light emitting diode. A radiant energy sensor is also carried within the housing. An increasing density of particulate matter in the chamber increases the level of reflected light. The radiant energy sensor, in turn provides an electrical output or indicium indicative of a developing fire.

Photoelectric detectors are known to be susceptible and to provide false alarms in the presence of high humidity. The apparatus 50 also includes a humidity detector 54. It will be understood that neither the structure of the photodetector 52 nor the structure of the humidity detector 54 are limitations of the present invention.

In accordance with the embodiment 50 of FIG. 3, in the presence of humidity above a predetermined level, an output line 54*a* of the humidity detector 54 exhibits a low impedance to ground. An output from the photodetector, on a line 52*a*, an indicium of the presence of a predetermined level of combustion products, indicative of a developing or actual fire condition, is inhibited in the electronics 40 for a predetermined period of time. In the absence of a predetermined level of humidity, the output on the line 54*a* exhibits a high impedance.

In the absence of a predetermined level of humidity, an indicium on the line 52*a* indicative of a developing or actual fire condition, as sensed by photodetector 52, is transmitted to the control/interface electronics 40 for communication to the control unit 12. In the presence of the predetermined level of humidity, the detector 54 exhibits the low impedance. As the humidity falls, the humidity detector 54 exhibits a high impedance state once again.

Figure 4:
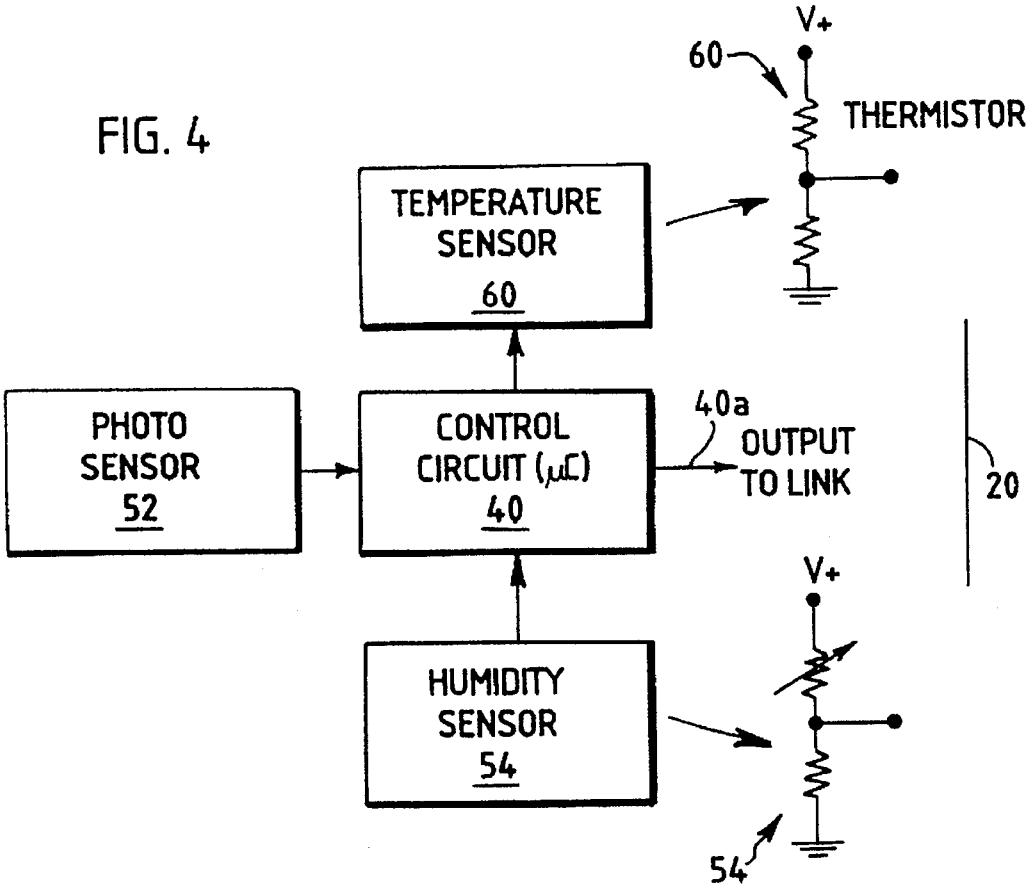
FIG. 4 illustrates a detector in accordance with the present invention.

FIG. 4 illustrates a preferred form of the invention wherein a humidity sensor 54, for example, commercially available humidity sensors from Philips, Visala or Panmetrics could be used, and a temperature sensor 60 are monitored by the control circuit 40. The control circuit 40 determines the rate of change of the output of the humidity sensor 54. The control circuit 40 also determines the rate of change of the output of the temperature sensor 60.

If the rates of change of the humidity sensor 54 and the temperature sensor 60 both exceed a predetermined value for each, the control circuitry 40 will delay any alarm response from the smoke sensor 52 in processing before outputting an alarm signal at line 40*a*. If the rate of change of the humidity sensor 54 is higher than a predetermined value and the rate of change of the temperature sensor 60 is higher than a predetermined value, then condensation is taking place and the control circuit 40 temporarily delays any alarms that may occur because it is most likely that the alarms are due to the condensation and not smoke.

The delay is limited to the time period where the condensation is determined to be present. The control circuit 40 monitors the humidity sensor 54, the temperature sensor 60, the smoke detector 52, and elapsed time to determine when the delay should be removed.

If the smoke detector goes out of alarm within a predetermined time period and returns to normal, then the delay is set to zero. If the rate of change in the humidity sensor and the change in the temperature sensor both decrease to zero or go negative, then the delay is limited to an additional 60 seconds during which time the smoke detector should return to normal.

The advantage of this structure is that false alarms are prevented. As a result, the fire detection system operates more reliably. A signal is sent from the control circuit 40 to the control unit 12 indicating that the delay is activated in the detector. However, the allowable temperature limit during condensation is below 135° F. If the thermal sensor measures a temperature above 135° F., then the delay is removed from alarming with the smoke detector because the probability of a fire coincident with the condensation becomes high.

FIG. 5 is a plurality of graphs illustrative of the functioning of the circuitry of FIG. 4, plotted as a function of time. The output of the photosensor 52 is plotted as graph (a) as a function of time. Similarly the outputs of the humidity sensor 54 and the temperature sensor 60 are plotted respectively as graphs (b) and (d).

The change in humidity, plotted as graph (c) indicates that when the humidity rises above a predetermined minimum level, and assuming the temperature is within predetermined limits, the delay period is started as illustrated in graph (f). The delay period provided in FIG. 5 is on the order of 60 seconds. As illustrated, the potential false alarm period 64, falls within the 60 second delay period. This indication has been inhibited thereby avoiding the generation of a false alarm.

It will be understood that various forms of humidity detector could be used without departing from the spirit and scope of the present invention. It will also be understood that as an alternate, the output line 54*a*, see FIG. 3, could be coupled to the radiant energy source, or the sensor of the detector 52. In the presence of humidity, the response of one or the other could be disabled or delayed thereby blocking generation of a fire indicating. indicium on the line 52*a*.

It will be understood that in accordance with the present invention, more than one nonsmoke sensors can be used at a time. Outputs from the plurality of nonsmoke sensors can be combined with one or more outputs from fire sensors in accordance with the present invention.

Further, in accordance with the present invention, the rates Of change of the signals from the non-fire sensors can be taken into account as described above. The non-fire sensor do not need to be in the same housing as do the fire sensor or sensors. The non-fire sensors can be located spaced apart from one another as well as spaced apart from the fire sensors. All of the output can then be combined at the control unit 12. Hence, the non-fire sensors can be combined and allocated as desired .among various different fire sensors.

Additionally, the extent of the delay time can be established and determined in response to signals from the non-fire sensors. Alternately, this delay time can be determined in response to the rate of change of the signals from the non-fire sensors.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A fire detector comprising:

a housing;

a fire sensor carried by said housing wherein said sensor produces a fire related electrical signal indicative of a sensed fire condition;

another sensor carded by said housing wherein said another sensor produces an electrical output indicative of a different sensed ambient condition;

control circuitry carried by said housing and coupled to said sensors wherein said control circuitry determines a rate of change of said electrical output and blocks said fire related electrical signal for a predetermined period of time when said rate of change exceeds a preset value.

2. A detector as in claim 1 which includes a second sensor different from said another sensor, carried by said housing wherein said second sensor is coupled to said control circuitry and produces a second electrical output indicative of a second sensed ambient condition, wherein said control circuitry determines a rate of change of said second electrical output.

3. A detector as in claim 1 wherein said another sensor includes a humidity sensor.

4. A detector as in claim 2 wherein said second sensor includes a temperature sensor.

5. A fire detection system comprising:

a fire sensor wherein said sensor produces a fire related electrical signal indicative of sensed fire condition;

another sensor wherein said another sensor produces an electrical output indicative of a different sensed ambient condition;

control circuitry coupled to said sensors wherein said control circuitry determines a rate of change of said electrical output and blocks said fire related electrical signal for a predetermined period of time when said rate of change exceeds a preset value.

6. A detection system as in claim 5 wherein said another sensor includes a temperature sensor.

7. A detection system as in claim 5 wherein said another sensor includes a humidity sensor.

8. A detection system as in claim 5 which includes a communications link which extends between said control circuitry and said sensors.

* * * * *

UNITED STATES PATENT AND TRADEMARK OFFICE

CERTIFICATE OF CORRECTION

PATENT NO. : 5,659,292

DATED : Aug. 19, 1997

INVENTOR(S): Lee D. Tice

It is hereby certified that error appear(s) in the above-identified patent and that said Letters Patent is hereby corrected as shown below:

In Col. 3, line 14, "Opera-" should be --operat--;

In Col. 5, line 28, "Of", first occurrence, should be --of--;

In Col. 6, line 7, "carded" should be --carried--.

Signed and Sealed this

Eighteenth Day of May, 1999

*Attest:*

*Attesting Officer*

Q. TODD DICKINSON

*Acting Commissioner of Patents and Trademarks*